US008166714B2

(12) United States Patent
Ziegelman

(10) Patent No.: US 8,166,714 B2
(45) Date of Patent: May 1, 2012

(54) BUILDINGS FORMED OF A PLURALITY OF PREFABRICATED MODULES

(76) Inventor: Robert L. Ziegelman, Bloomfield Hills, MI (US)

( * ) Notice: Subject to any disclaimer, the term of this patent is extended or adjusted under 35 U.S.C. 154(b) by 74 days.

(21) Appl. No.: 12/517,592

(22) PCT Filed: Oct. 6, 2008

(86) PCT No.: PCT/US2008/078952

§ 371 (c)(1),
(2), (4) Date: Dec. 21, 2009

(87) PCT Pub. No.: WO2009/046423

PCT Pub. Date: Apr. 9, 2009

(65) Prior Publication Data

US 2011/0016801 A1 Jan. 27, 2011

Related U.S. Application Data

(60) Provisional application No. 60/977,435, filed on Oct. 4, 2007.

(51) Int. Cl.
*E04H 1/00* (2006.01)

(52) U.S. Cl. ..... 52/79.2; 52/79.12; 52/220.2; 52/236.3

(58) Field of Classification Search ..... 52/79.1, 52/79.2, 79.8, 79.12, 220.1, 220.2, 234, 236.3, 52/236.4, 236.6, 236.8, 236.9, 745.02, 745.03, 745.08, 745.1, 745.13, 745.2
See application file for complete search history.

(56) References Cited

U.S. PATENT DOCUMENTS

| | | | | |
|---|---|---|---|---|
| 3,461,633 | A * | 8/1969 | Ziegelman et al. | 52/643 |
| 3,623,296 | A * | 11/1971 | Santoro | 52/79.12 |
| 5,528,866 | A * | 6/1996 | Yulkowski | 52/79.12 |
| 5,575,120 | A * | 11/1996 | Handley | 52/79.1 |
| 2004/0103596 | A1 * | 6/2004 | Don et al. | 52/79.1 |
| 2007/0074463 | A1 * | 4/2007 | Ziegelman | 52/79.1 |
| 2008/0134589 | A1 * | 6/2008 | Abrams et al. | 52/79.1 |

FOREIGN PATENT DOCUMENTS

| | | | |
|---|---|---|---|
| JP | 09032325 | A | 2/1997 |
| JP | 2004084310 | A | 3/2004 |
| KR | 1020010089315 | A | 9/2001 |
| KR | 1020030008723 | A | 1/2003 |

* cited by examiner

*Primary Examiner* — Jessica Laux
(74) *Attorney, Agent, or Firm* — Gifford, Krass, Sprinkle, Anderson & Citkowski, P.C.

(57) ABSTRACT

Prefabricated, steel framed, rectangular building modules are joined in groups to form multi-unit residences, or commercial or institutional buildings. The modules are disposed in rectangular groups abutting one another so as to form a central rectangular core bounded by the units. Utilities are connected to each module through the core. Multiple story buildings are formed by similar groups having cores aligned vertically. Alternating stories are rotated relative to one another about the central core axis to produce cantilevered structures.

5 Claims, 10 Drawing Sheets

BUILDINGS FORMED OF A PLURALITY OF PREFABRICATED MODULES

CROSS-REFERENCE TO RELATED APPLICATIONS

This application is the U.S. national phase of PCT/US2008/078952 filed Oct. 6, 2008, which claims priority of U.S. Provisional Patent Application Ser. No. 60/977,435 filed Oct. 4, 2007, which is incorporated herein by reference.

FIELD OF THE INVENTION

This invention relates to building modules having rigid frames formed of beams and covered with wall panels and to structures suitable for use as residential, commercial or institutional buildings formed with such modules.

BACKGROUND OF THE INVENTION

Rectangular building modules have previously been used to construct multi-unit buildings for use as residences and in commercial and industrial centers. By way of example, my U.S. Pat. No. 3,461,633 titled "Prefabricated Building Structure" discloses a modular prefabricated building structure formed with a rigid frame of tubular beams suitable for use as a residence, commercial or industrial building, either by itself, or in combination with similar related modules.

Prefabricated building modules have gained increasing marketplace acceptance since the time of my original patents, due to the economies of mass production and the general ability to perform operations in a factory setting which would be impossible or uneconomical at the construction site. There clearly exists a need for similar modules incorporating improved materials and construction techniques and for multi-unit structures incorporating these modules.

SUMMARY OF THE INVENTION

The present invention is accordingly directed toward a rigid framed rectangular module suitable for a wide variety of applications and to an innovative method of stacking these modules to form multifamily housing units, industrial, institutional and retail structures and the like.

Additionally, I have developed novel stacking arrangements particularly suitable for use of the prefabricated modules. These stacking arrangements achieve compact structures with the appearance of custom designed buildings which masks their factory origin. A wide variety of multimodal structures may be formed using the present invention.

A preferred stacking arrangement broadly involves joining four rectangular modules with their central axes arranged in alternating orthogonal directions. One rectangular corner of each of the modules is devoted to a common utility core area shared by all four of the modules. Stories above the first story are designed in a complementary manner so that the units do not stack one above the other, but the patterns of the modules at each level are varied. In a two level stack, modules in the second level cantilever over the modules of the first level, and modules in the first level project beyond the upper modules so that portions of their roof are exposed in the completed structure. The result is an irregular yet harmonious appearance which lends itself to forming clusters of the modules which produce a heterogeneous appearance. The modules are also well adapted to be arrayed in clusters on inclined surfaces to produce varying appearance and sight lines. They may also be combined with multistory modules to produce a unique community appearance.

BRIEF DESCRIPTION OF THE DRAWINGS

Other aspects, advantages and applications of the present invention will be made apparent by the following detailed description of the accompanying drawings. The description makes reference to the accompanying drawings in which.

DETAILED DESCRIPTION OF THE INVENTION

Figure 1:
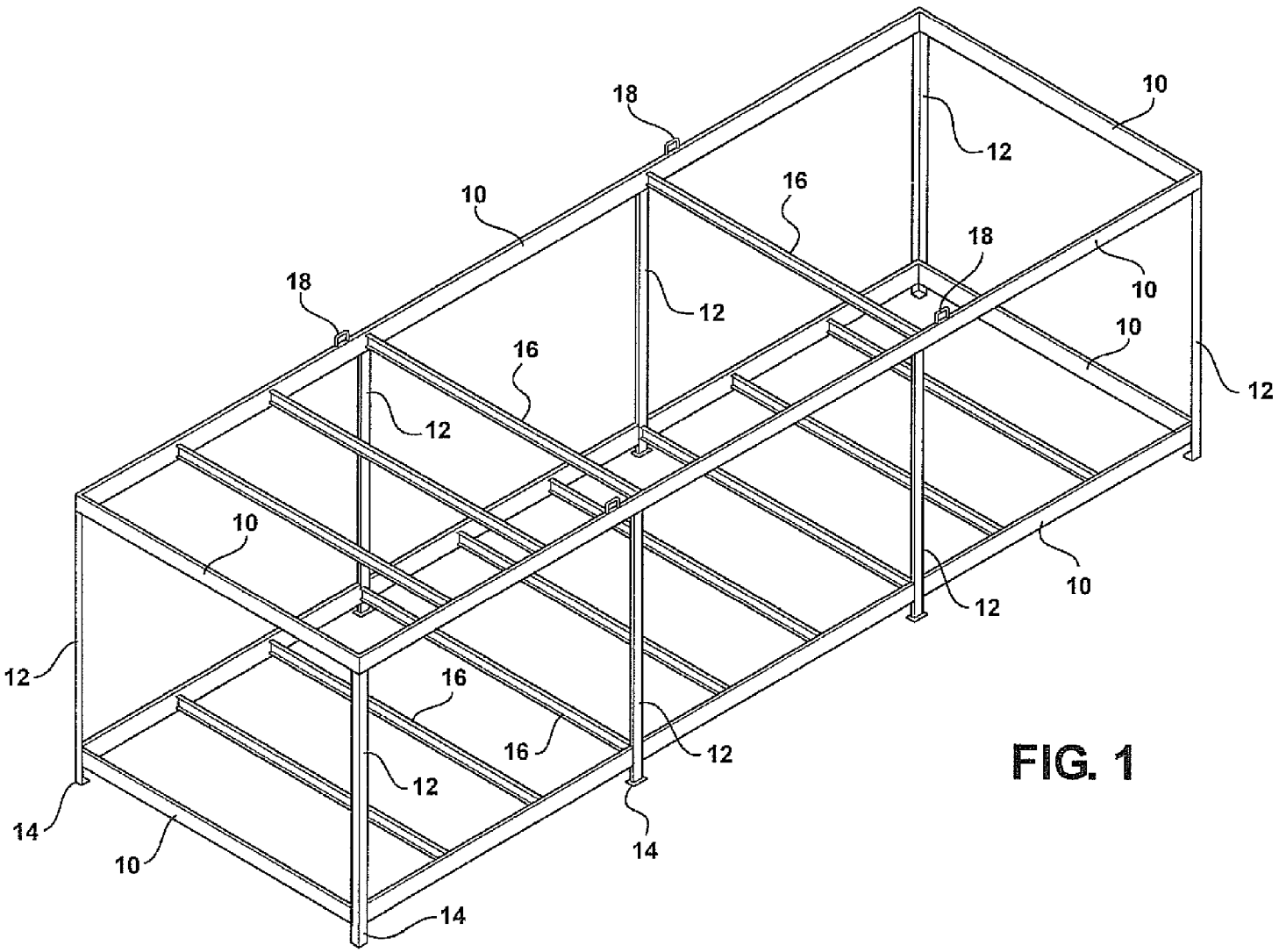
FIG. 1 is an isometric drawing of a preferred embodiment of a module useful with the present invention.
Figure 2:
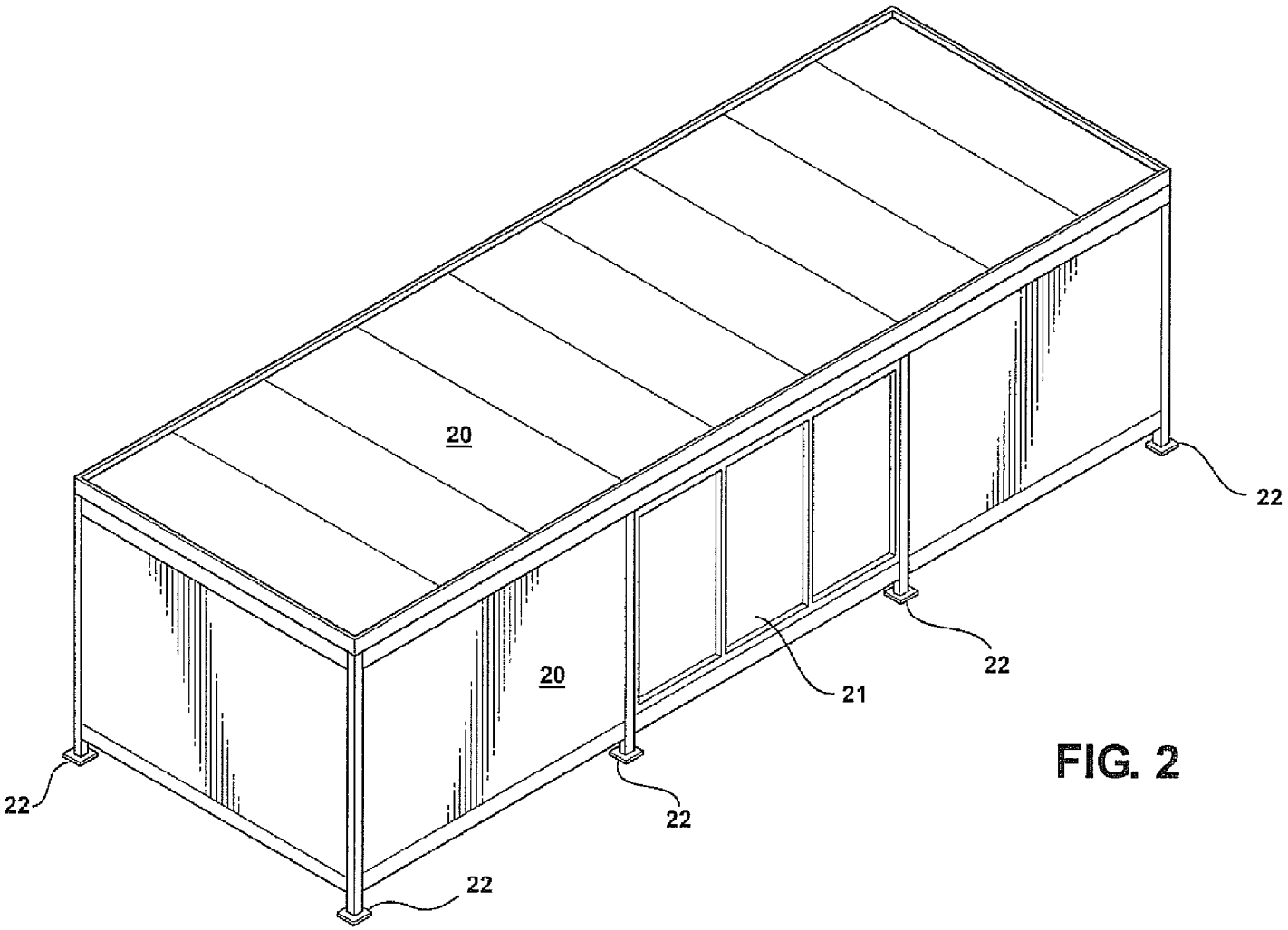
FIG. 2 is an isometric section of the module of FIG. 1 in its completed form with floor, roof, wall panels, windows and foundation pads.

FIGS. 1 and 2 illustrate a basic form of the rectangular, rigid frame, module forming the preferred embodiment of the present invention. FIG. 1 illustrates the module in frame form and FIG. 2 in finished form with floor, roof, and wall panels, windows and foundation pads. The modules are formed of a welded steel frame. In a preferred embodiment the outer framing members 10 are formed of C channels. In other embodiments they could be tubular members. The vertical members 12, which join the framing members 10, are preferably formed of steel 2×4 tubular sections; and the cross framing members 14 may be junior beams. The corner 2×4 framing members may extend downwardly to provide legs 14.

Joists 16 extend across the width of the module to support floor and ceiling panels. The joints are preferably welded.

The second floor module is substantially similar except that there are no legs 14 and a number of lifting hooks 18, preferably four in number, are attached to the top framing members to allow the second floor structures to be lifted by cranes on top of the first floor structures.

FIG. 2 shows a typical manner in which the first floor structure may be covered by insulated panel 20 and aluminum glass panels or door walls 21 and in which foundation pads 22 may be attached to the bottom of legs 14.

The modules may of course differ in size and proportions from those illustrated in FIGS. 1-2, but are preferably steel framed and rectangular in configuration.

Figure 3:
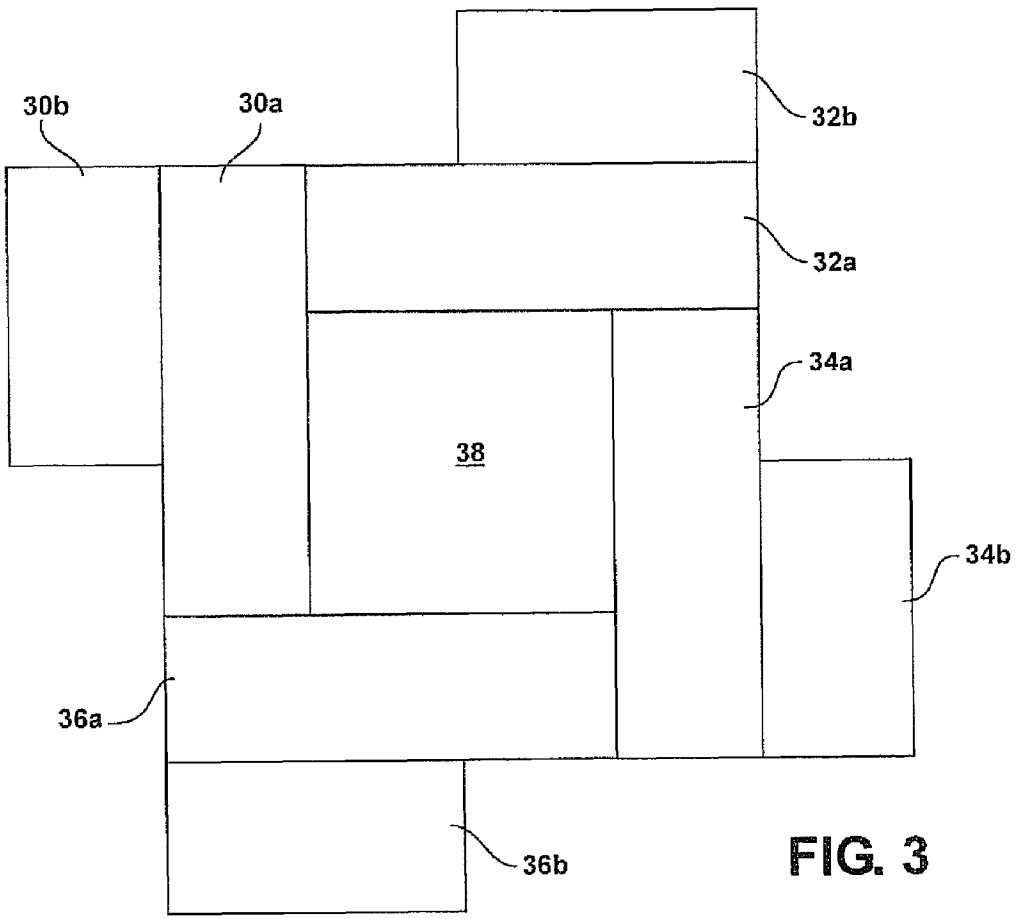
FIG. 3 is a plan view of a structure incorporating four of the modules joined together to form a unitary structure incorporating a central utility core formed by all four of the modules.

FIG. 3 illustrates how modules may be joined together to form four residences. FIG. 3 constitutes a plan view of an aggregate of eight modules which form four residential units. Four of the modules 30*a*, 32*a*, 34*a* and 36*a* are rectangular in form and relatively long. Each of these units is paired with a shorter module, 30*b*, 32*b*, 34*b* and 36*b*. Thus the two contiguous modules 30*a* and 30*b* form one dwelling unit, the modules 32*a* and 32*b* a second dwelling unit, the modules 34*a* and 34*b* a third dwelling unit, and the modules 36*a* and 36*b* the fourth dwelling unit. Each pair of modules forming one dwelling unit have appropriate interior walls and doors (not shown) so as to create a single dwelling unit.

The units are arrayed in rectangular configuration, with the major axes of the units 30*a* and 30*b* parallel to the major axes of the units 34*a* and 34*b*, and with the major axes of the units 32*a* and 32*b* parallel to the major axes of the units 36*a* and 36*b*. The resulting structure is rectangular with an unoccupied central core 38, which is formed by one quadrant of each of the four modules 30*a*, 32*a*, 34*a* and 36*a* and acts as a utility core. The four dwelling modules share the central utilities provided through the core 38.

Broadly the modules are arrayed so that each module has a section of a vertical wall bordering and defining the central rectangular core area 38 and each module has sections of its vertical walls abutting sections of vertical walls of at least two other modules.

The units are particularly useful to form emergency housing after a natural disaster such as a hurricane, fire, etc. Bringing all of the utilities 38 for the four units (or additional units which may be supported on the four units, as will be subsequently disclosed) great economies of connection time are achieved.

Figure 4:
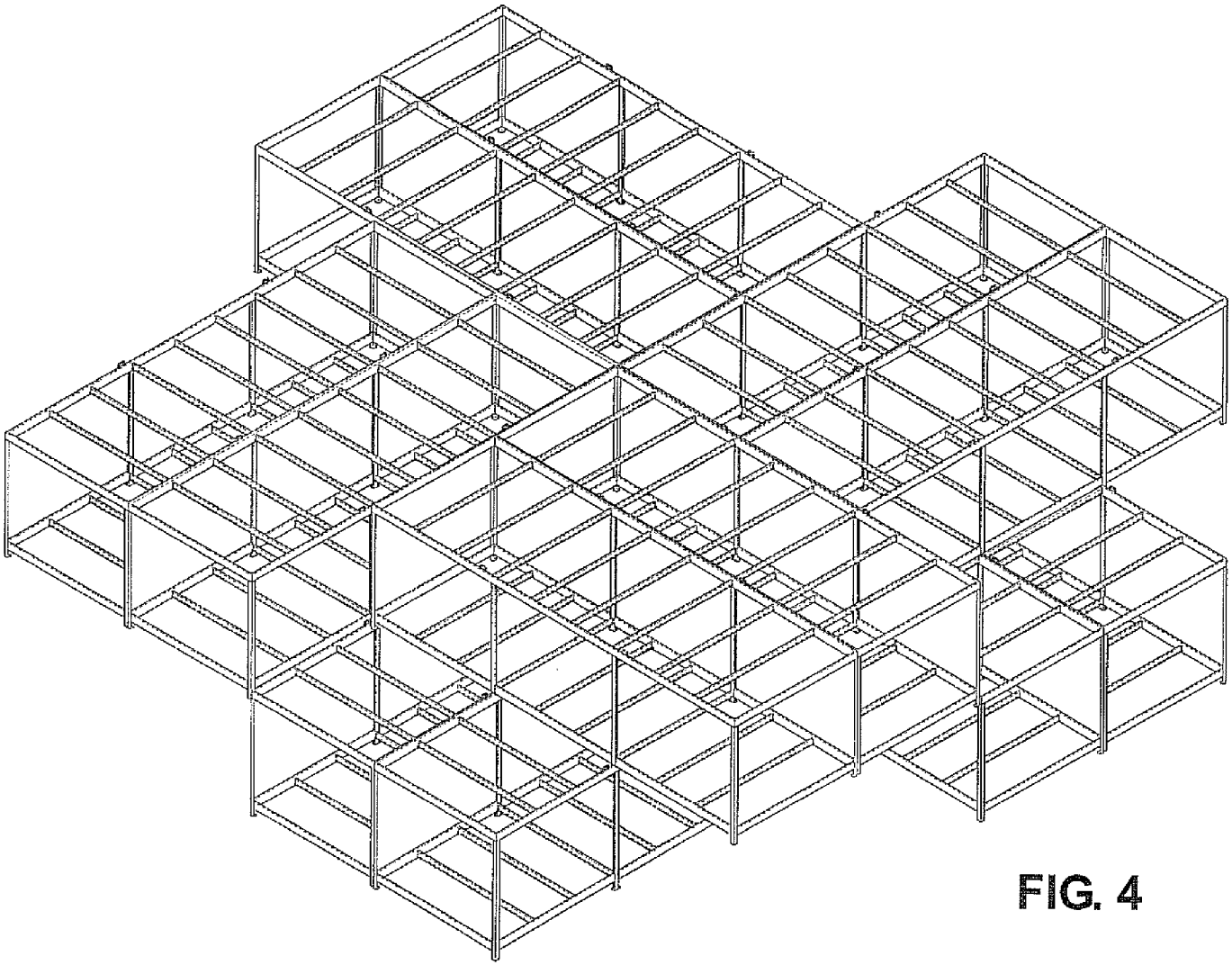
FIG. 4 is an isometric view of a two story structure incorporating two levels, each like the level of FIG. 4, but varied in layout to provide cantilevered sections.

Two or more sets of modules, of the type generally indicated in FIG. 3, may be stacked one on top of the other in the manner illustrated in FIG. 4. The plans for each level are rotated by 90 degrees with respect to one another so that the modules are not arrayed directly on top of one another, but sections of the top modules cantilever beyond the lower modules and sections of the top of the lower modules are exposed. The central utility core extends through both levels of modules. In this arrangement the modules are double wide and have a distinct aesthetic appearance.

A wide variety of multistory combinations of the modules may be created in which the levels of modules are not stacked directly above and below each other, but an upper level projects beyond the support provided by the lower level, in a cantilevering manner. This construction is possible because of the strength of the metal beams used to form the modules. The beams are preferably of steel but could be aluminum in some cases.

The vertically staggered result of this non-uniform stacking arrangement provides an aesthetically pleasing appearance to the structures, which may be varied from structure to structure, so as to avoid a uniform appearance. The arrangement also provides excellent sound insulation and exterior ventilation conditions when compared to structures in which multiple levels of modules are directly stacked upon one another.

Figure 5:
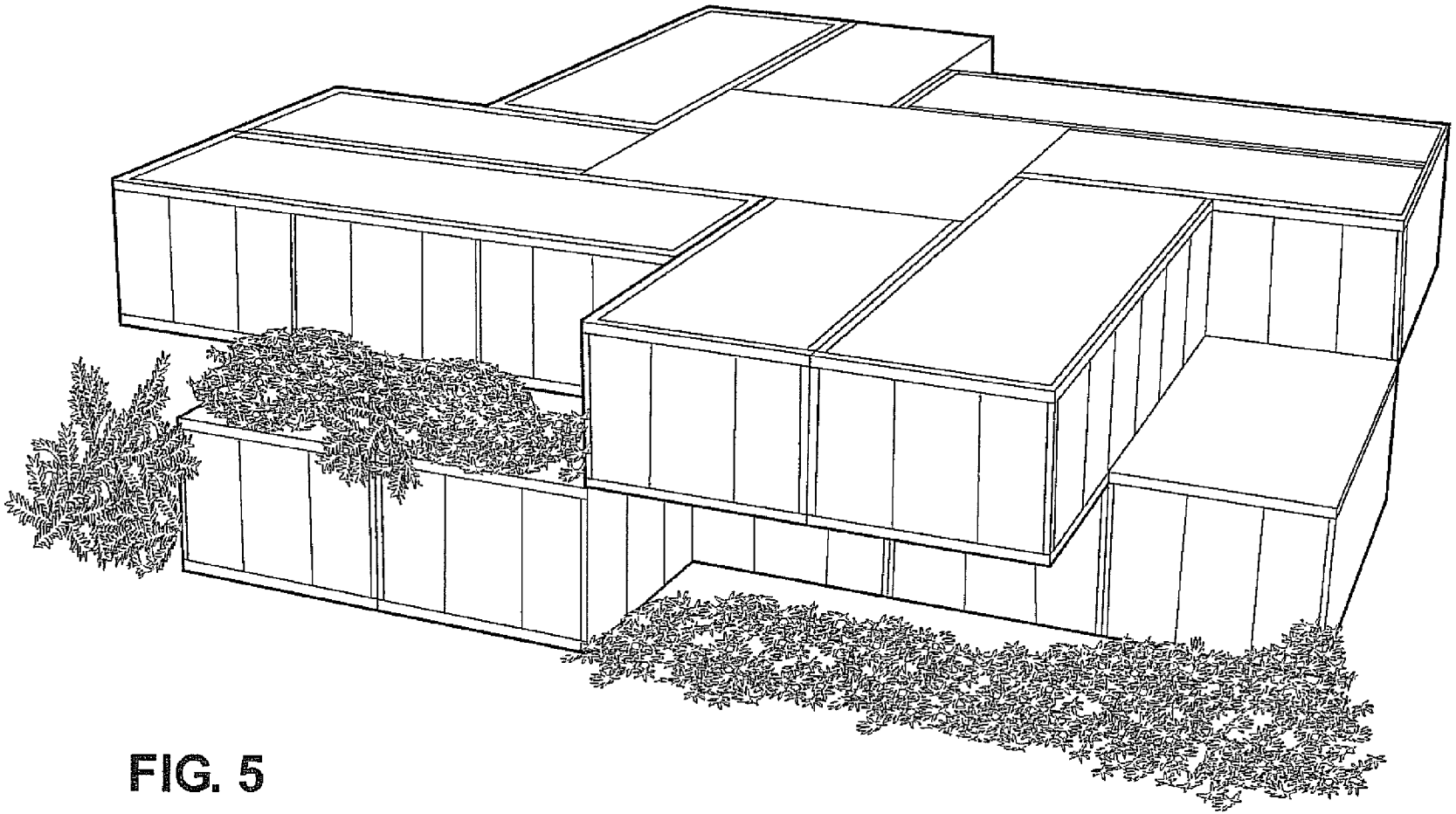
FIG. 5 is a perspective view of a completed structure formed in accordance with FIG. 5.

FIG. 5 illustrates the two level modular array of FIG. 4 in a finished form, illustrating a variety of finishes that may give a distinctive appearance to the module group.

Figure 6:
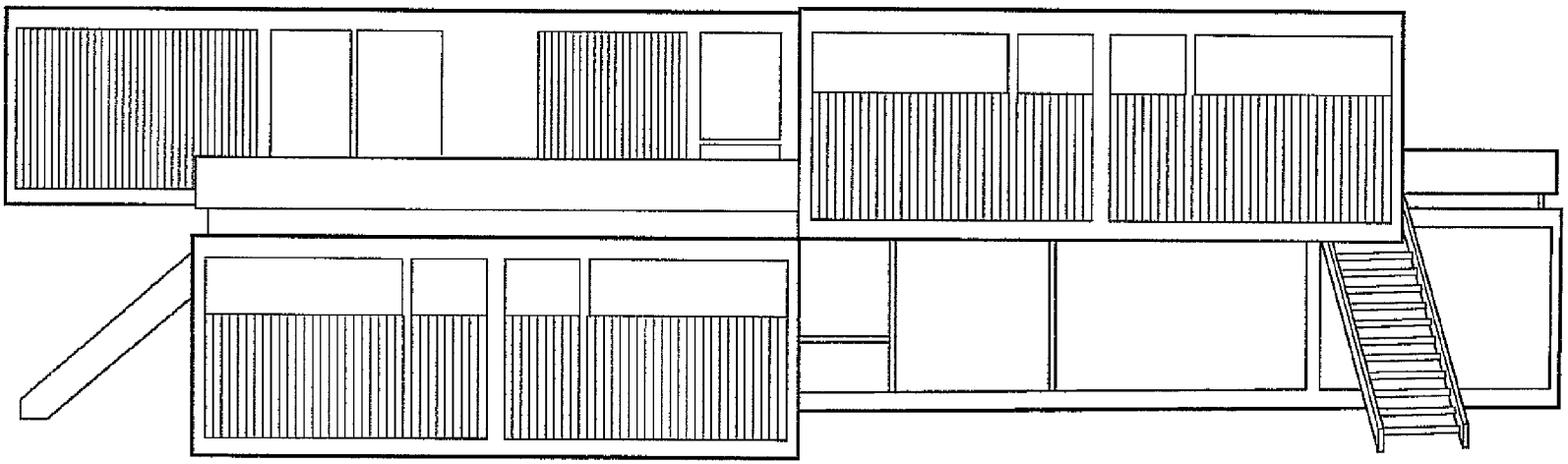
FIG. 6 is a perspective view of a two story module like FIGS. 5 and 6 with finishing details.
Figure 7:
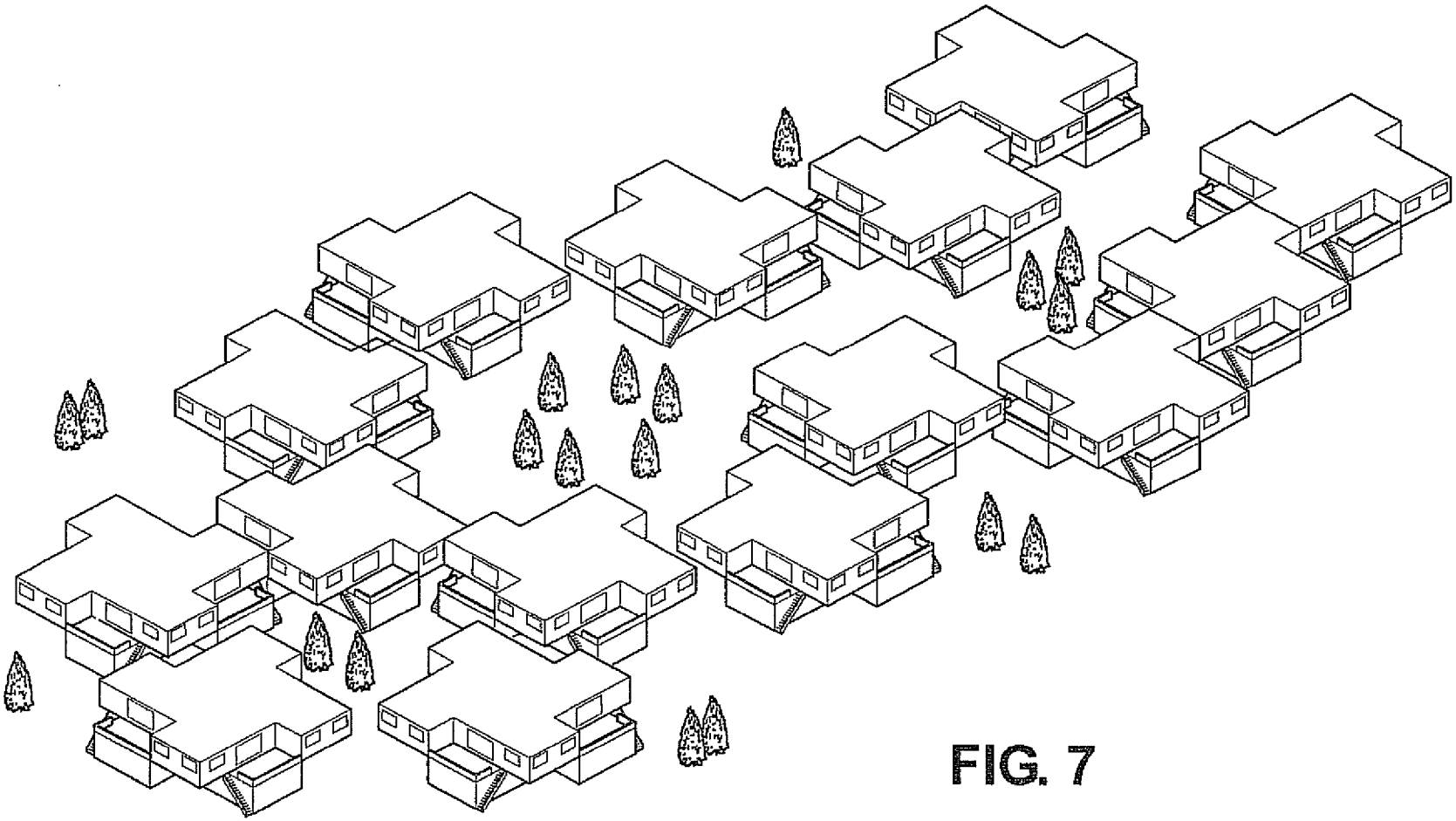
FIG. 7 is a site study of a cluster of modular structures arrayed on a site plan.
Figure 8:
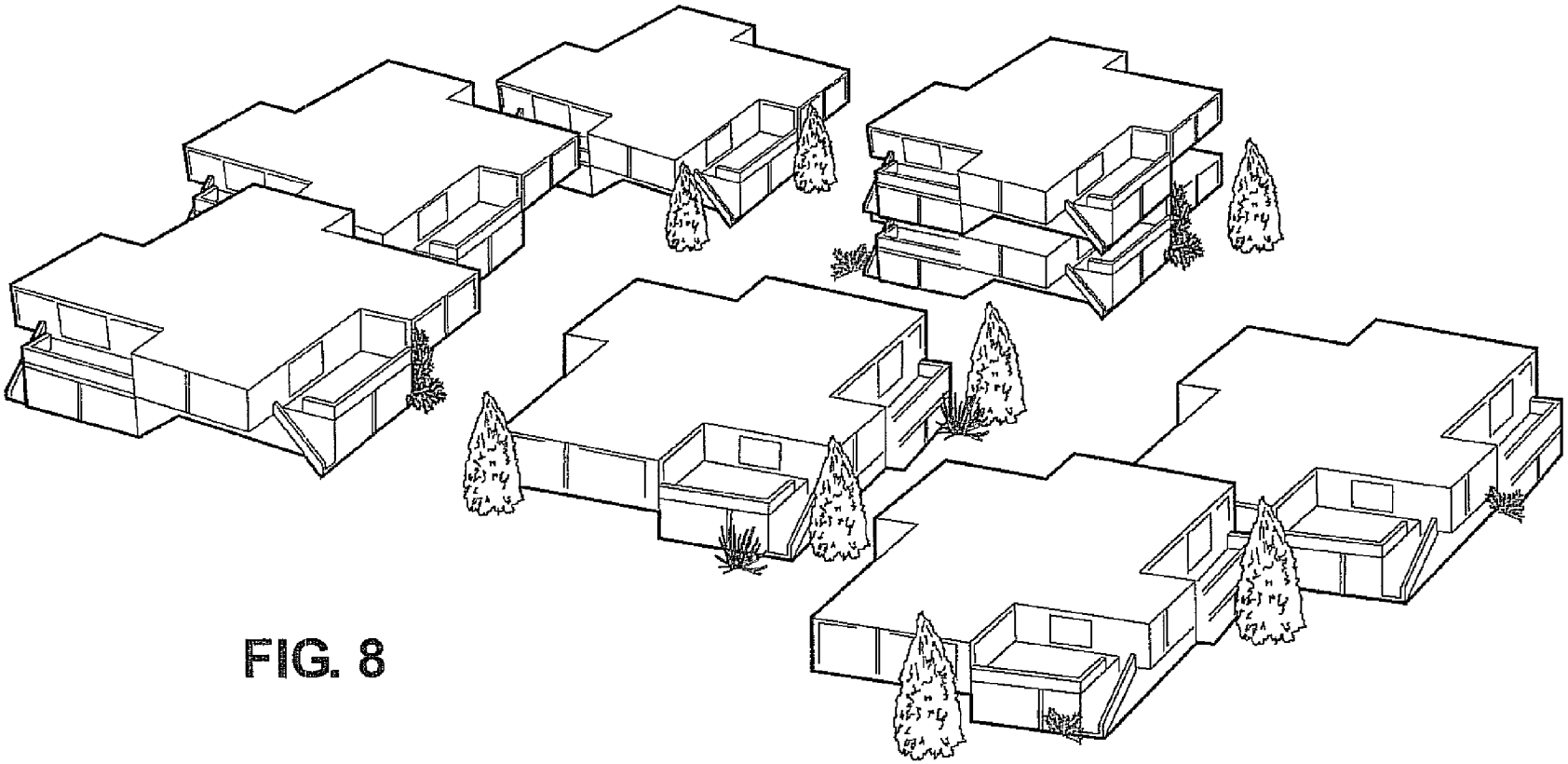
FIG. 8 is a site study variation like FIG. 7.
Figure 9:
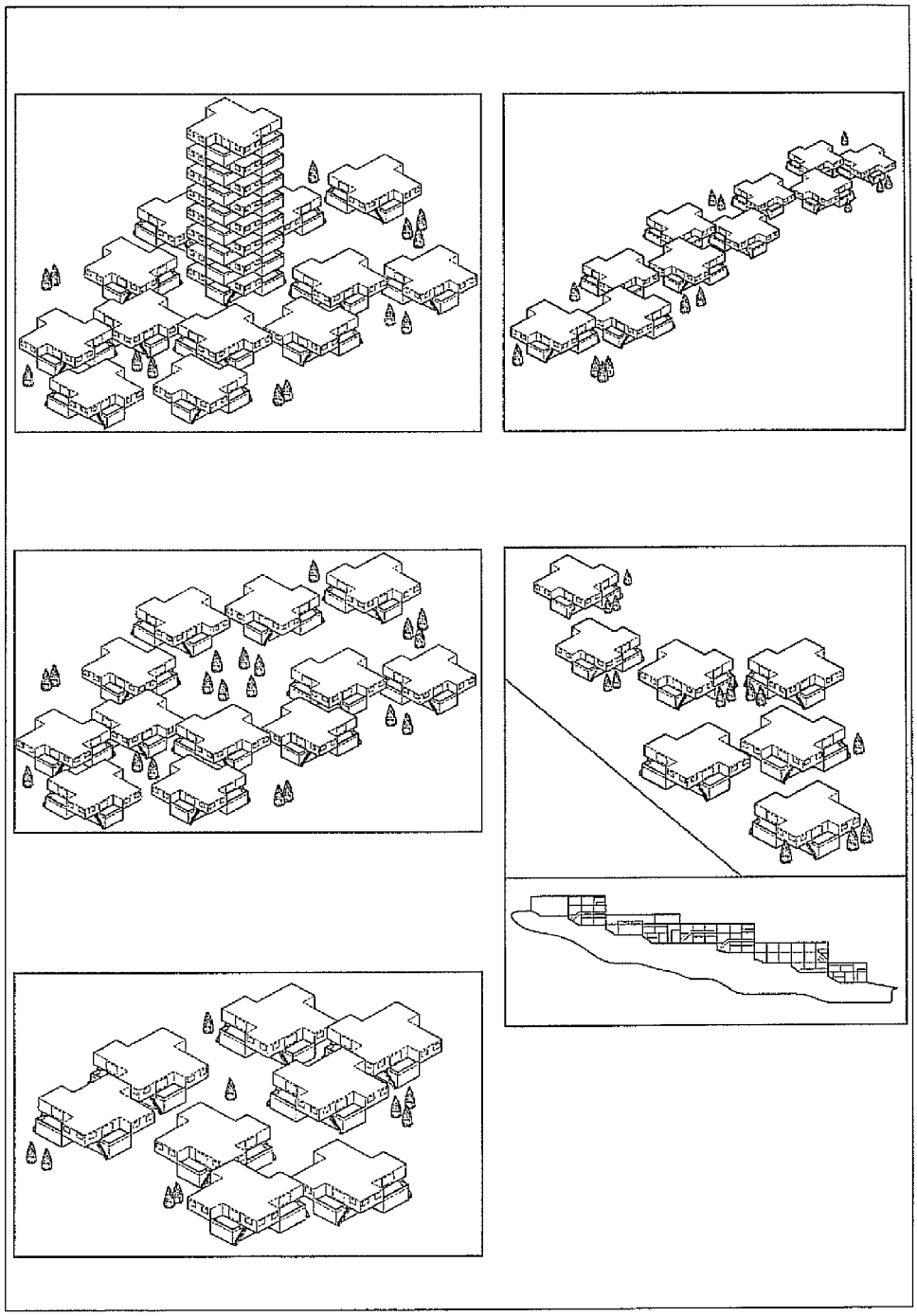
FIG. 9 is an illustration of a variety of site variations, including a central high-rise tower in one of the variations.

The modules may be finished in a variety of manners such as the one shown in FIG. 6. Groups of modules of the types illustrated in FIGS. 4 and 5 may be arrayed over a site in a non-regular manner, as illustrated in FIG. 7, to provide an aesthetically varied community of modules. FIGS. 8 and 9 illustrate a variety of site arrangements which may vary depending upon the topography of the land. High-rise towers, as illustrated in the upper left-hand corner of FIG. 10, may be interposed among the modules to further vary the aesthetics of the arrangement. The high-rise could be formed by a plurality of stacked modules of the type shown in FIGS. 1-2.

Figure 10:
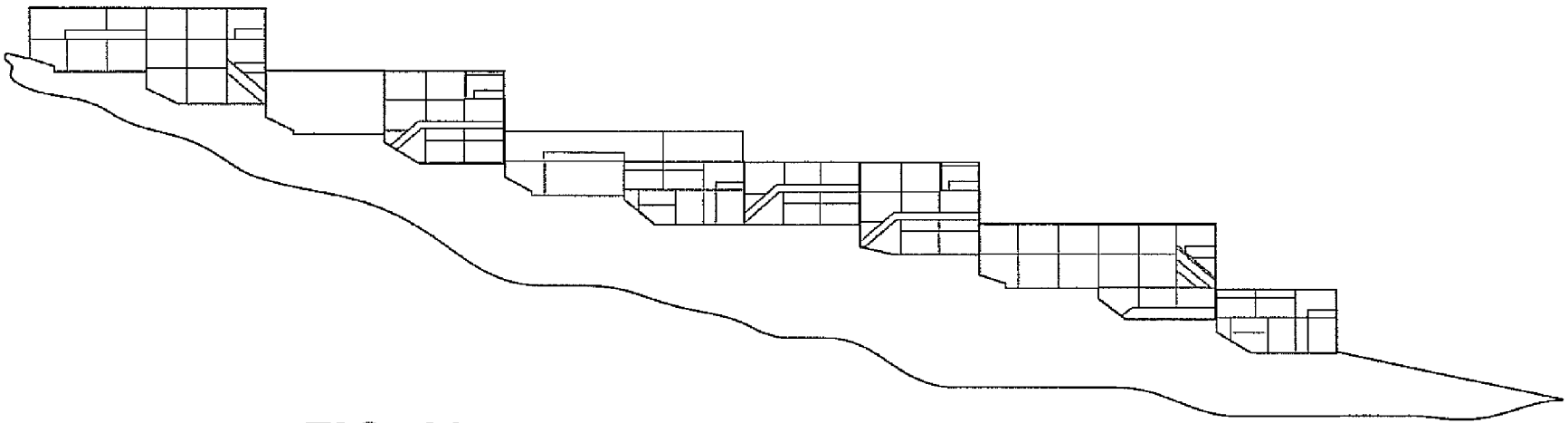
FIG. 10 is an elevation view of a structure formed by a plurality of two level modules arranged along a sloping site.

FIG. 10 illustrates an elevation view of the plurality of the modules arrayed along a sloped terrain.

It is clear that the basic modules, while uniform, may be joined together in a variety of aesthetically pleasing combinations to provide communities which give the appearance of custom design despite the factory manufactured nature of the individual modules.

Having thus described my invention, I claim:

1. A multi-level building structure formed of a plurality of prefabricated rectangular modules, the modules being rigid framed with panels overlying the frames to form at least certain of the walls of the modules, the structure being characterized by: each of the levels comprising a plurality of modules being arrayed so that each module has a section of a vertical wall bordering and defining a central rectangular core area and each module has sections of its vertical walls abutting sections of vertical walls of at least two other modules, and utilities accessible to all of the modules through the core area, and each level above the lowest being supported on top of the next lower level so that the loads created by the upper levels are supported through the rigid frames of the underlying levels.

2. The building structure of claim 1 in which at least four of the modules have lengths greater than their widths; a first pair of modules having lengths greater than their widths being disposed separated from one another with their lengths parallel to one another; a second pair of the modules having lengths greater than their widths being disposed separated from one another with their lengths parallel to one another and perpendicular to the lengths of said first pair of modules, with one end of each of the modules forming the first and second pair of modules abutting a side wall of a module of the other pair to form said central core area.

3. The building structure of claim 1 wherein the core areas of the first and second levels coincide, so that the core area of the second level is disposed above the core area of the first level, and the modules forming said second level are rotated by 90 degrees relative to the modules forming the first level, about the central axis of the core, whereby certain of the modules of the second level extend beyond the members of the first level in a cantilevered fashion.

4. The building structure of claim 1 wherein the frame members constitute metal.

5. The building structure of claim 1 in which the modules form a plurality of residential units.

* * * * *